US010060146B2

(12) United States Patent
Simmons et al.

(10) Patent No.: US 10,060,146 B2
(45) Date of Patent: Aug. 28, 2018

(54) I-BEAM-ATTACHABLE LIFELINE SYSTEM

(71) Applicant: ConXtech, Inc., Pleasanton, CA (US)

(72) Inventors: Robert J. Simmons, Hayward, CA (US); Maxwell C. Simmons, Hayward, CA (US); Daniel R. Hester, Oakland, CA (US)

(73) Assignee: ConXtech, Inc., Pleasanton, CA (US)

( * ) Notice: Subject to any disclaimer, the term of this patent is extended or adjusted under 35 U.S.C. 154(b) by 71 days.

(21) Appl. No.: 14/680,003

(22) Filed: Apr. 6, 2015

(65) Prior Publication Data

US 2015/0284968 A1 Oct. 8, 2015

Related U.S. Application Data

(60) Provisional application No. 61/976,389, filed on Apr. 7, 2014.

(51) Int. Cl.
*A62B 35/00* (2006.01)
*E04G 21/32* (2006.01)

(52) U.S. Cl.
CPC ..... *E04G 21/3295* (2013.01); *A62B 35/0068* (2013.01); *A62B 35/0081* (2013.01); *E04G 21/3276* (2013.01); *Y10T 29/49959* (2015.01)

(58) Field of Classification Search
CPC ..... A62B 35/0081; A62B 35/0087; A62B 35/0068; A62B 35/0043; A62B 35/005; A62B 35/0056; A62B 35/0062; E04G 21/3261; E04G 21/3295; E04G 21/3276; E04G 5/045; E04G 21/3204; F16L 13/24
USPC ..... 248/228.1, 228.2, 228.4, 228.7
See application file for complete search history.

(56) References Cited

U.S. PATENT DOCUMENTS 1,929,325 A 10/1933 Masterson
2,346,338 A * 4/1944 Sway ..... E04G 3/22 182/94
2,765,139 A * 10/1956 White ..... E04B 9/18 248/228.4
2,916,244 A * 12/1959 Renfroe ..... B66C 1/64 105/154

(Continued)

FOREIGN PATENT DOCUMENTS

DE 20313403 U1 12/2003

OTHER PUBLICATIONS

U.S. Receiving Office, International Search Report in International Patent Application No. PCT/US2015/024584, dated Jan. 7, 2016, 2 pages.

(Continued)

*Primary Examiner* — Daniel P Cahn
(74) *Attorney, Agent, or Firm* — Kolisch Hartwell, P.C.

(57) ABSTRACT

I-beam-attachable lifeline system, including methods and apparatus, for worker safety. In some embodiments, the system may comprise a frame structure including upright columns and horizontal I-beams. The system also may comprise a pair of fittings connected to a horizontally-spaced pair of the I-beams. Each fitting may have a first hook component and a second hook component received on respective opposite edge regions of a flange of an I-beam of the pair of I-beams and attached to one another with a fastener such that the fitting spans the flange transversely and is supported by the I-beam. The system further may comprise a cable having opposite ends connected to the pair of fittings.

10 Claims, 4 Drawing Sheets

(56) References Cited

U.S. PATENT DOCUMENTS 3,217,833 A * 11/1965 Smith ..... E04G 21/3261 182/3
3,350,755 A * 11/1967 Hanner ..... F16L 3/24 138/99
3,379,414 A * 4/1968 Thurnauer ..... E04F 11/181 256/68
4,367,972 A 1/1983 Panthout
4,371,203 A * 2/1983 Munro ..... B66C 1/64 294/103.1
5,036,949 A * 8/1991 Crocker ..... A62B 35/04 182/3
5,146,724 A * 9/1992 Angelo ..... F16B 2/02 248/228.1
5,526,896 A * 6/1996 O'Rourke ..... A62B 35/0068 182/3
5,529,144 A * 6/1996 Henderson ..... A62B 35/0056 182/3
5,711,397 A * 1/1998 Flora ..... A62B 35/0062 182/3
6,009,973 A * 1/2000 Woodyard ..... A62B 35/0081 182/36
6,053,279 A * 4/2000 McKenna ..... A62B 35/0081 182/3
6,237,303 B1 5/2001 Allen et al.
6,298,629 B1 * 10/2001 Ador ..... A62B 35/005 182/3
6,354,399 B1 * 3/2002 Austin ..... A62B 35/0087 182/3
6,520,290 B1 * 2/2003 Carter ..... A62B 35/0037 182/3
6,520,705 B2 * 2/2003 Stasney, Jr. ..... F16B 2/065 248/72
6,581,725 B2 6/2003 Choate
6,691,826 B1 * 2/2004 Dean ..... E04G 21/3214 182/113
7,048,090 B2 * 5/2006 Dean ..... A62B 35/0056 182/3
8,167,258 B1 * 5/2012 Wentworth ..... E04B 1/2403 248/214
8,646,575 B1 2/2014 Guthrie et al.
8,991,883 B1 * 3/2015 Butterfield, IV ..... B66C 1/64 294/67.3
9,291,288 B2 * 3/2016 Simmons ..... F16L 3/18
9,320,924 B2 * 4/2016 Patel ..... A62B 35/0037
2001/0011694 A1 * 8/2001 Lycett ..... A62B 35/0068 248/228.1
2002/0168220 A1 * 11/2002 Stasney, Jr. ..... F16B 7/18 403/201
2003/0006095 A1 * 1/2003 Desjardins ..... A62B 35/0087 182/36
2004/0195479 A1 * 10/2004 Gulley ..... F16B 2/12 248/228.1
2006/0272889 A1 12/2006 Paquette
2010/0215429 A1 * 8/2010 Raye ..... B60T 7/20 403/408.1
2010/0294560 A1 11/2010 Dahl
2012/0298444 A1 * 11/2012 O'Reilly ..... A62B 35/0056 182/3

OTHER PUBLICATIONS

U.S. Receiving Office, Written Opinion of the International Searching Authority in International Patent Application No. PCT/US2015/024584, dated Jan. 7, 2016, 11 pages.
The International Bureau of WIPO, International Preliminary Report on Patentability regarding International Patent Application No. PCT/US2015/024584, dated Oct. 20, 2016, 13 pages.

* cited by examiner

I-BEAM-ATTACHABLE LIFELINE SYSTEM

CROSS-REFERENCE TO PRIORITY APPLICATION

This application is based upon and claims the benefit under 35 U.S.C. § 119(e) of U.S. Provisional Patent Application Ser. No. 61/976,389, filed Apr. 7, 2014, which is incorporated herein by reference in its entirety for all purposes.

INTRODUCTION

Workers must be protected by an anti-fall device during construction of a ground-supported steel frame composed of columns and I-beams, such as for a high-rise building. For example, workers may be tethered to the frame with safety lines designed to arrest a worker's fall, thus preventing serious injury or death. However, such safety lines are often frame-specific, instead of standardized, and can require significant time and effort to rig them safely. Also, the safety lines can excessively restrict worker mobility and reduce efficiency.

SUMMARY

The present disclosure provides an I-beam-attachable lifeline system, including methods and apparatus, for worker safety. In some embodiments, the system may comprise a frame structure including upright columns and horizontal I-beams. The system also may comprise a pair of fittings connected to a horizontally-spaced pair of the I-beams. Each fitting may have a first hook component and a second hook component received on respective opposite edge regions of a flange of an I-beam of the pair of I-beams and attached to one another with a fastener such that the fitting spans the flange transversely and is supported by the I-beam. The system further may comprise a cable having opposite ends connected to the pair of fittings.

DETAILED DESCRIPTION

Figure 1:
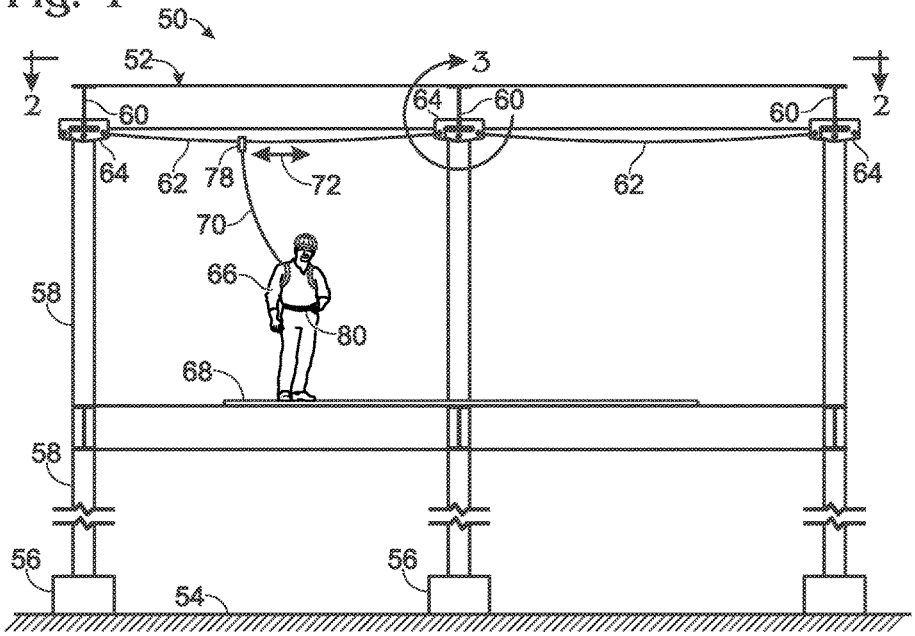
FIG. 1 is a schematic, cross-sectional view of selected aspects of an exemplary lifeline system, taken generally along line 1-1 of FIG. 2, and including (a) a frame structure including vertical columns and horizontal I-beams, (b) cables connected to pairs of the I-beams via corresponding pairs of fittings, and (c) a worker on a platform and tethered to one of the cables with a releasable safety line, in accordance with aspects of the present disclosure.

The present disclosure provides an I-beam-attachable lifeline system, including methods and apparatus, for worker safety. In some embodiments, the system may comprise a frame structure including upright columns and horizontal I-beams. The system also may comprise a pair of fittings connected to a horizontally-spaced pair of the I-beams. Each fitting may have a first hook component and a second hook component received on respective opposite edge regions of a flange of an I-beam of the pair of I-beams and attached to one another with a fastener such that the fitting spans the flange transversely and is supported by the I-beam. The system further may comprise a cable having opposite ends connected to the pair of fittings.

The present disclosure relates to a worker-safety, horizontal lifeline, I-beam-attachable system. The system may include a fitting as a basic component for connection of a cable to an I-beam. The system may include a pair of such fittings to connect a cable to a pair of laterally adjacent horizontal I-beams that are present in a frame, such as a frame under construction.

The present disclosure provides a fitting that may be formed from a pair of generally C-shaped, interdigitatable hook components, which may be centrally pinned together through fastener structure to form a unit slidably disposed on a flange of an I-beam located above a worker. The hook components may be designed so that when they are pinned together, they are configured to accommodate use with a wide range of cross-sectional I-beam sizes.

Opposite, laterally spaced ends of each fitting may be furnished with anchor points for attaching the ends of I-beam-to-I-beam catenary lifeline cables, which may reside overhead a worker and may have an upper end of a worker-specific safety line releasably attached thereto. An anti-rotation stop plate may be included in each hook component to prevent the hook components from opening rotationally once they are installed for use.

With the invention fittings in place, for example on a pair of laterally adjacent I-beams, a worker below can freely and extensively move in a number of different directions during frame construction, with such movement accommodated by the longitudinal sliding capabilities of the fittings along the lengths of their associated I-beams.

If a worker falls with all system components properly in place, related load developed in the catenary cable may be borne at a pair of outwardly-facing, spaced regions in the adjacent I-beams, where the central webs in these beams join with the beam's lower flanges. These regions in the beams are conventionally radiused, and each of the fittings may include opposing fingers that are similarly radiused for region-specific, load-bearing purposes.

The fittings of the present disclosure, when in place on laterally-adjacent beams, may provide engagement of their fingers with opposite sides of webs of the associated I-beams. The engagement furnishes datum points for predetermining the appropriate, inter-fitting lengths of the cables, which allows for appropriate pre-sizing of cables to enable their easy installation between pairs of fittings after attachment of the fittings to I-beams.

Further aspects of the present disclosure are described in the following sections: (I) overview of a lifeline system, (II) fittings, and (III) methods of lifeline installation and use.

I. Overview of a Lifeline System

Figure 2:
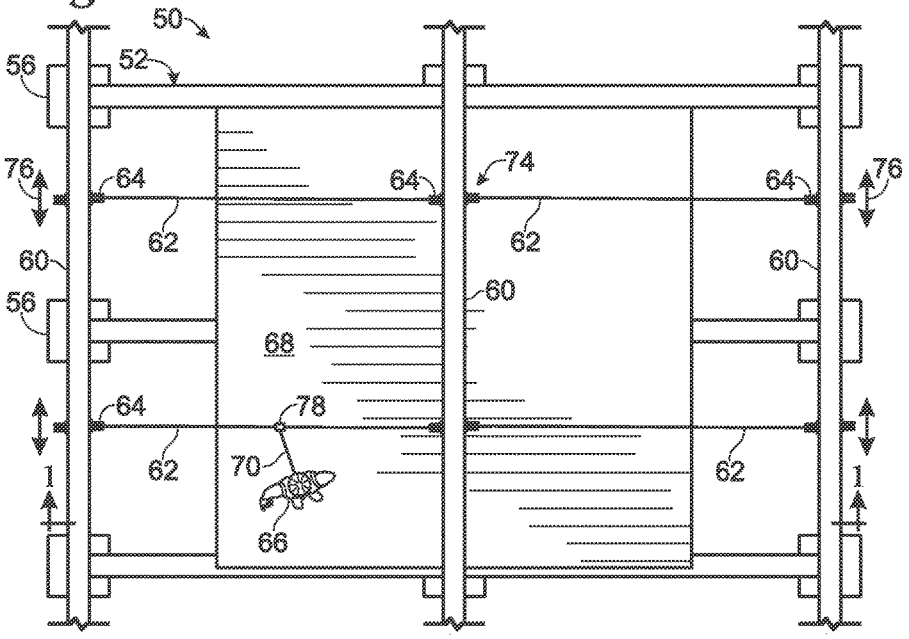
FIG. 2 is a fragmentary top view of the lifeline system of FIG. 1, taken generally along line 2-2 of FIG. 1.

This section provides an overview of exemplary lifeline systems of the present disclosure; see FIGS. 1 and 2.

FIG. 1 shows a schematic, cross-sectional view of selected aspects of an exemplary lifeline system 50. The system may include a frame structure 52 supported by the ground 54 and composed, at least in part, of footings 56 at the bottom, columns 58 extending vertically above the footings, and I-beams 60 extending horizontally between the columns. A cable 62 may be connected to one or more adjacent pair of I-beams 60 via a pair of fittings 64 each attached to and supported by one of the I-beams. A worker 66 located on and supported by a work surface, for example, platform 68 above ground 54 and below cable 62 may be tethered releasably to the cable with a safety line 70 (interchangeably termed a tether). The platform may not have a railing or other safety barrier that prevents the worker from stepping off the edge of the platform. In any event, safety line 70 is short enough to arrest any fall from the platform that may occur. The upper end of the safety line 70 may be slidably connected to the cable, indicated by a motion arrow at 72, to permit the safety line to be moved along the cable as needed.

FIG. 2 shows a schematic top view of lifeline system 50. A plurality of cables 62 may be connected to frame structure 52 at the same elevation. Two or more of the cables may be arranged parallel to one another, as shown, and/or two or more of the cables may be arranged transverse (e.g., orthogonal) to one another. A pair of the cables may be connected to the same pair of I-beams with two pairs of fittings 64. Alternatively, or in addition, a pair of the cables may be connected to the same I-beam 60 via the same fitting 64, indicated by an arrow at 74, and may extend in opposite directions from the I-beam to a pair of non-adjacent I-beams 60. Furthermore, a pair of the cables also or alternatively may be connected to two pairs of I-beams arranged coaxially with one another. A pair of the cables also or alternatively may be connected to a rectangular arrangement of four I-beams such that the cables cross one another. In any event, the plurality of cables may form a parallel and/or orthogonal arrangement that allows a worker to move across platform 68 (and/or between platforms) and across any suitable portion of frame structure 52 while remaining safely tethered to one of the cables. The worker may switch the connection of worker-specific safety line 70 between different cables 62, as needed for worker mobility. The system of cables also allows a team of workers 66 to remain safety tethered with a set of worker-specific safety lines while working above the ground.

In some embodiments, a pair of fittings may be arranged on a vertical line. An upper fitting may be connected to the bottom portion of an upper I-beam, and a lower fitting may be connected to the top portion of a lower I-beam (at upper flange 92). A cable may be connected to both fittings and may extend vertically between the fittings.

Each fitting 64 may be slidably supported by one of I-beams 60, indicated by motion arrow 76, to permit the fitting to travel along the I-beam before or after a cable is connected to the fitting. In some cases, a pair of the fittings, while connected to the same cable, may be moved along their associated I-beams to reposition the cable along the I-beams. Alternatively, or in addition, a pair of fittings 64 may be moved along their respective I-beams to a desired position for a cable 62, before the cable is connected to both fittings.

Frame structure 52 may have any suitable components and configuration. The frame structure may be a substantially complete frame containing its final set of columns and I-beams, or may be a frame under construction to which columns and/or I-beams will be added to complete the frame.

Footings 56 may be permanent or temporary, and may or may not be anchored in place. Each footing may include concrete, such as poured into a form, and may or may not be at least partially embedded in an excavated area. In some examples, the footing may include a temporary ground support assembly located completely above the ground.

Columns 58 may be solid or hollow, may be formed at least partially of metal, and may or may not be filled with concrete. Exemplary columns have a rectangular or circular cross section. The frame structure may have a bottom level of columns anchored to footings 56 and, optionally, one or more additional levels of columns stacked on the bottom level of columns, such as in coaxial alignment with individual columns of the bottom level.

I-beams 60 may be mounted to the columns in an orthogonal arrangement with the columns. Each I-beam may be constructed at least partially of metal and may extend horizontally between a pair of columns to interconnect and stabilize the columns. The frame structure may have horizontal grids of I-beams spaced vertically from one another.

A cable, as used herein, includes any line, rope, and/or belt and associated interface structure. The cable may be formed as a bundle of elongate elements, or may be monolithic along a majority of the cable's length, among others. The cable may have a length sufficient to span the distance between the cable anchor sites of a pair of I-beam-attached fittings 64. Exemplary cables may be formed of metal, polymer, natural fibers, a combination thereof, or the like. Accordingly, the cable may, for example, include a rope formed by a bundle of metal wires or non-metallic filaments/fibers. The cable may have any suitable cross-sectional shape, such as circular, rectangular, or the like. The cable may, in some cases, include discrete links (e.g., links of chain). The cable may have connecting elements, such as loops, rings, hooks, perforated brackets, or the like, formed and/or mounted at opposite ends to enable attachment of each end of the cable to a fitting 64. The cable may be described as a catenary cable when mounted to a pair of fittings. The catenary cable follows a curved path between its opposing ends, namely, a path that arcs downward to a central region of the cable from one of the ends and then arcs upward from the central region to the other end of the cable.

Platform 68 may be any elevated support on which one or more workers may stand, sit, lie, or a combination thereof. Platform 68 may also be used to support other objects, for example, one or more pipes, and/or other equipment or apparatus. The platform may be separate from frame structure 52 (e.g., a mobile lift), may be integral to the frame structure, or may be a temporary/removable scaffold, among others.

Safety line 70 may include at least one cable that is capable of supporting the weight of a worker, if necessary. The safety line also may include connecting elements located at opposite ends of the cable. The upper end of the safety line may include a clip 78 to releasably attach the safety line to cable 62. The lower end of the safety line may include a connector for attachment to a harness 80 worn by the worker.

Cable 62 also or alternatively may be used to support equipment and/or supplies for the worker(s). For example, at least one tool, container, and/or the like may be connected to the cable at a fixed position or an adjustable position along the cable. In some embodiments, the tool/container may be slidable along the cable to provide convenient access for the worker.

II. Fittings

This section describes exemplary aspects of fitting 64; see FIGS. 3-8.

Figure 3:
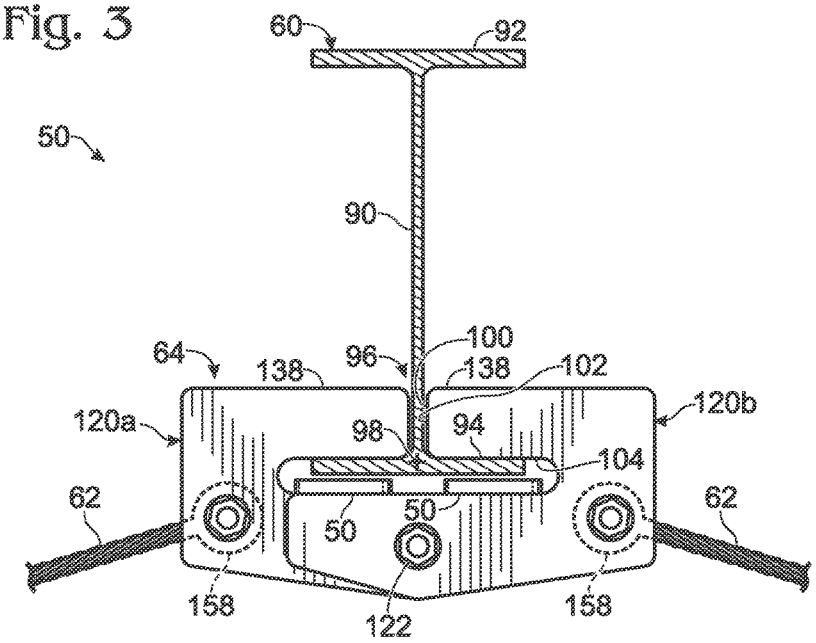
FIG. 3 is a fragmentary, sectional view of the system of FIG. 1, taken generally around the region indicated at "3" in FIG. 1 through an I-beam and toward a fitting slidably supported by the I-beam and connected to a pair of cables.

FIG. 3 shows a view of lifeline system 50 taken cross-sectionally through one of I-beams 60 toward a fitting 64 attached to the I-beam. The I-beam has a central, vertical web 90 and upper and lower flanges 92, 94 each arranged horizontally and joined to the top and the bottom of the web, respectively. Fitting 64 defines a receiving region 96 that can be assembled around a bottom portion of I-beam 60 and that interfaces with the beam, as described in more detail below, to attach the fitting to the I-beam. The I-beam extends through the receiving region on a through-axis 98 defined by the receiving region after assembly of the fitting.

Fitting 64 alternatively may be assembled around a top portion of I-beam 60, with the fitting inverted with respect to the orientation shown in FIG. 3. In that case, the fitting is assembled around a top portion of I-beam 60 formed by web 90 and upper flange 92. However, because attachment to lower flange 94 is preferred, the following description focuses on assembling the fitting around a bottom portion of the I-beam for simplification.

Receiving region 96 may define an opening 100 having a T-shaped perimeter in profile (i.e., as viewed in profile in FIG. 3 along through-axis 98). The T-shaped perimeter may correspond to an inverted letter T, as shown in FIG. 3, if the fitting is attached to a bottom portion of the I-beam, or to the letter T in its standard orientation, if the fitting is attached to a top portion of the I-beam. In any event, opening 100 in profile may have a vertical section 102 through which web 90 extends, and a horizontal section 104 through which lower flange 94 (or upper flange 92) extends. Through-axis 98 may be centered in opening 100 at a junction of vertical section 102 and horizontal section 104.

Opening 100 may be oversized to accommodate I-beams of different sizes. Vertical section 102 of the opening may have a characteristic dimension, such as a width measured horizontally in profile (i.e., measured in a horizontal direction orthogonal to through-axis 98), that is greater than a thickness of web 90, measured in the same horizontal direction, thereby allowing webs 90 of different thickness to be received in opening 100. Horizontal section 104 may have a characteristic dimension, such as a length measured horizontally in profile (i.e., measured in a horizontal direction orthogonal to through-axis 98), that is greater than a width of lower flange 94 measured in the same horizontal direction, thereby allowing flanges 94 of different thickness to be received in opening 100. Furthermore, horizontal section 104 may have a characteristic dimension, a height, measured vertically in profile (i.e., measured in a vertical direction orthogonal to through-axis 98), that is greater than a thickness of lower flange 94 measured in the vertical direction, thereby allowing flanges 94 of different thickness to be received in opening 100. The width (or height) of web 90, measured vertically in FIG. 3, is greater than a height of vertical section 102, measured vertically, but otherwise the width/height of the web is unconstrained, thereby allowing I-beams 60 having a wide range of web widths/heights to be used with fitting 64. The fitting may be slidable along the I-beam after attachment to the I-beam, if vertical and horizontal sections 102, 104 of opening 100 are oversized, respectively, with respect to the thickness of web 90 and the width of lower flange 94 (as shown in FIG. 3). In other embodiments, the fitting may be fixed in position on the I-beam, if movement along the I-beam is undesirable.

Fitting 64 may include a pair of hook components 120*a*, 120*b* that are assembled around lower flange 94 and attached to another with at least one fastener 122 (a single fastener is used in the depicted embodiment). Fastener 122 may be described as a fastener assembly including a bolt 124, a nut 126, and one or more washers 127) (see FIG. 7). Bolt 124 may have a shaft of sufficient length to extend through the fitting, with a threaded region of the shaft protruding from the fitting for threaded engagement with nut 126. Washers 127 optionally may be positioned between the head of the bolt and the fitting and/or between the nut and the fitting.

Figure 4:
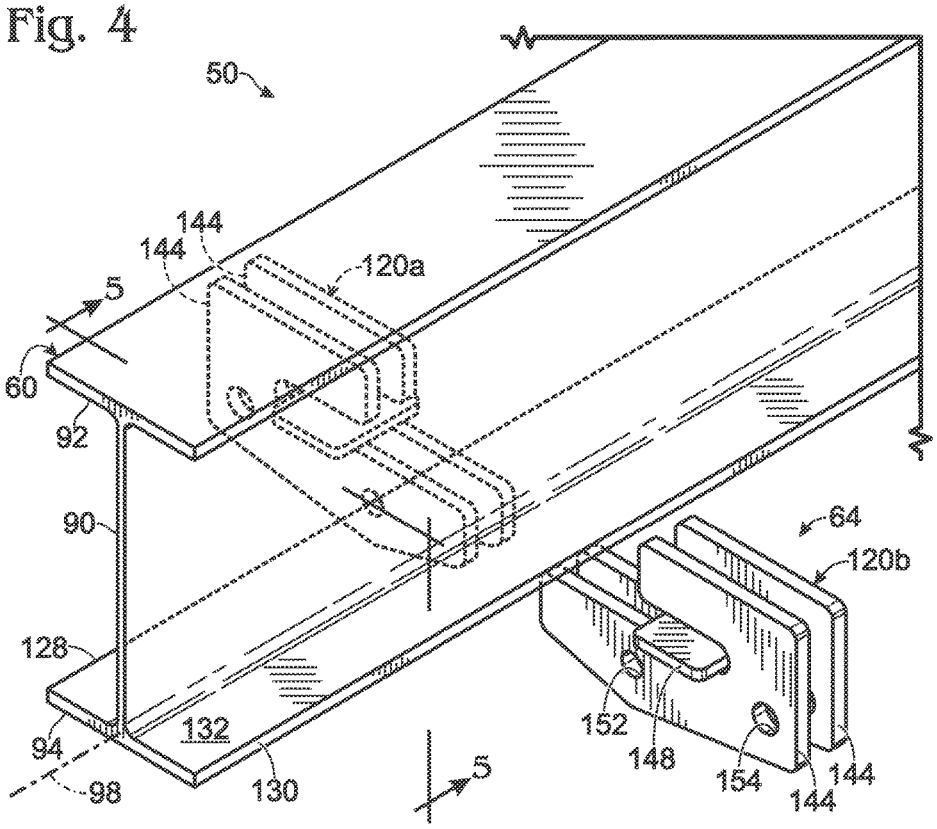
FIG. 4 is an isometric view of the fitting and I-beam of FIG. 3 taken in the absence of fasteners and cables and with hook components of the fitting exploded horizontally from the I-beam.
Figure 5:
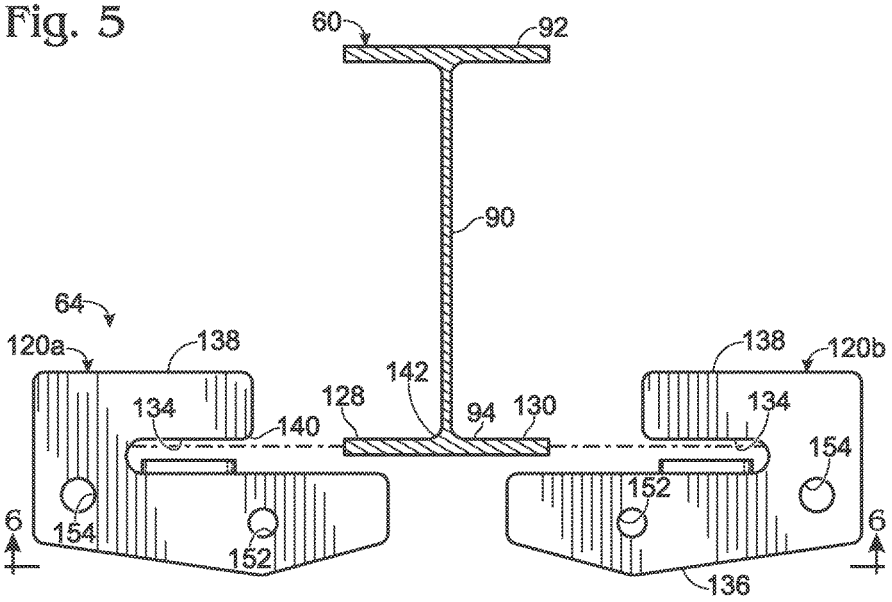
FIG. 5 is a cross-sectional, exploded view of the fitting and I-beam of FIG. 3, taken generally along line 5-5 of FIG. 4 through the I-beam.
Figure 6:
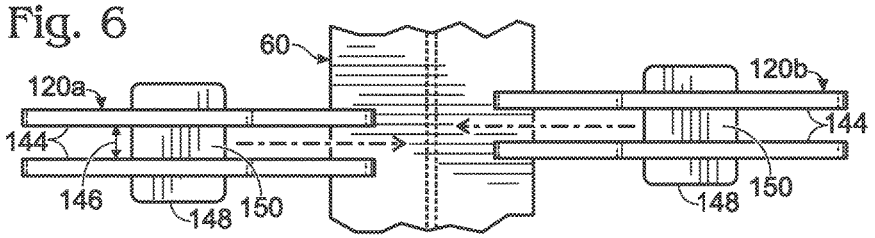
FIG. 6 is an exploded bottom view of the fitting and I-beam of FIG. 5, taken generally along line 6-6 of FIG. 5 from below the I-beam and fitting.
Figure 7:
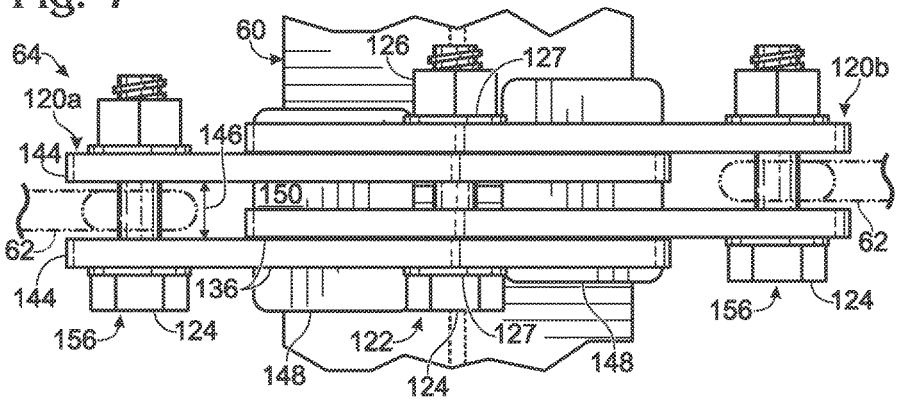
FIG. 7 is an assembled bottom view of the fitting and I-beam of FIG. 5 taken generally as in FIG. 6, but after the hook components have been interleaved and attached to one another with a central fastener, with cable-connecting fasteners installed, and with connected cables shown as fragmentary and in phantom outline.

Each hook component 120*a*, 120*b* may hook onto a different one of the opposite edge regions 128, 130 of lower flange 94 (see FIGS. 4 and 5). In the view of FIG. 5, hook component 120*a* is received on left edge region 128 of lower flange 94, and hook component 120*b* is received on right edge region 130 of lower flange 94. One or both of the hook components may contact a top side 132 of lower flange 94 (or a bottom side of upper flange 92).

The hook components collectively define opening 100 (see FIGS. 3 and 5). The hook components may define opposite branches of horizontal section 104 of opening 100. Hook component 120*a* may define a slot 134 forming the left branch of horizontal section 104, and hook component 120*b* may define a slot 134 forming the right branch of the horizontal section (see FIG. 5). The hook components collectively define vertical section 102 of opening 100 (see FIG. 3). The hook components may (or may not) be copies of one another, although use of copies can simplify assembly.

The hook components each may be generally C-shaped (see FIG. 5). Each hook component may have a base 136 formed on a lower side of slot 134 and a projecting portion, a finger 138, formed on an upper side of slot 134. Bases 136 of the pair of hook components may overlap one another when assembled, with fastener 122 extending through both bases 136 (see FIG. 7). Fingers 138 may project toward one another and toward respective opposite sides of web 90 (see FIG. 5). Each finger 138 may have a radiused end 140, which may be generally complementary to a radiused junction 142 formed by I-beam 60.

Each hook component 120*a*, 120*b* may include a pair of connected plate members 144 (also called plates) that face one another and are spaced from one another to form a gap 146 (see FIGS. 4, 6, 7, and 8). Plates 144 of the hook component may face one another across gap 146 and may be copies of one another (e.g., see FIGS. 7 and 8). Gap 146 may be larger than the thickness of each plate 144 of the other hook component, to allow either plate to be received in gap 146 (compare FIGS. 6 and 7). In other words, the hook components may be interleaved (e.g., interdigitated) with one another, with either plate 144 of each hook component received in the gap between plates 144 of the other hook component, when the hook components are assembled with and overlapping one another. In some embodiments, each hook component may include only one plate 144.

Figure 8:
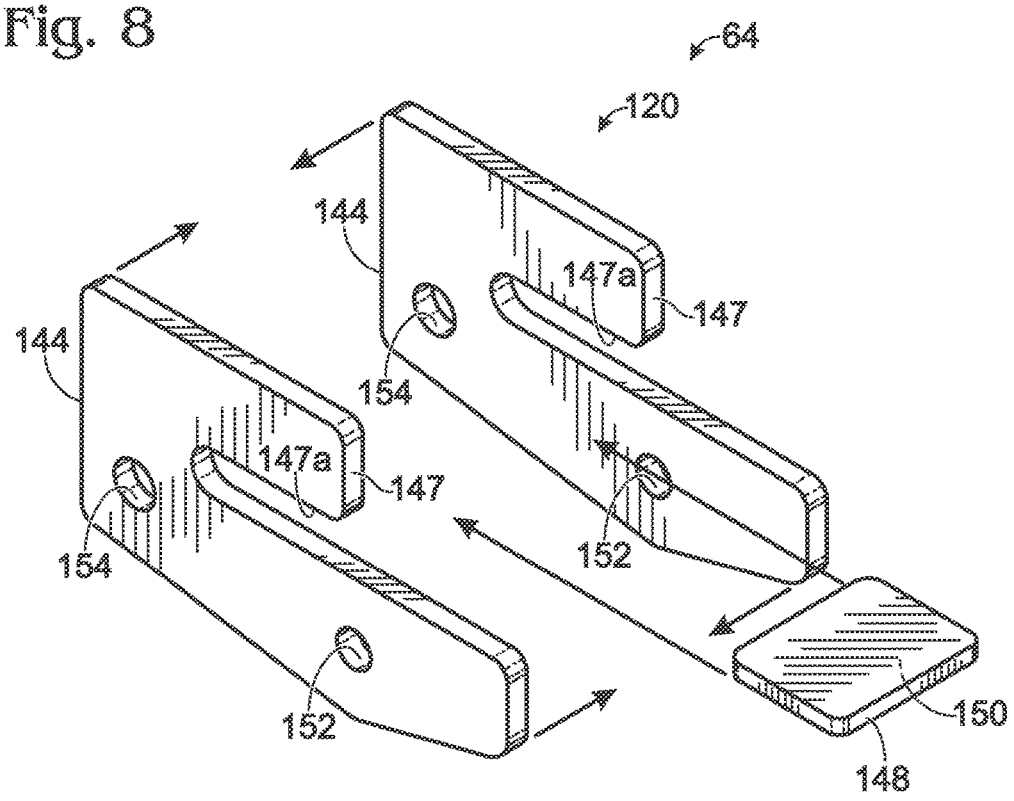
FIG. 8 is an isometric, exploded view of one of the hook components of a fitting of FIG. 1.

Each of plates 144 may form a hook 147 to extend around an edge region 128 or 130 of flange 94 of an I-beam (see FIGS. 4 and 8). Each plate 144 may define an indentation (a notch) 147*a* that forms one of the spaced portions of slot 134 (see FIGS. 5 and 8). The plates may be copies of one another.

Plates 144 of the hook component each may be joined, such as by welding, to a transverse member 148 (see FIGS. 5, 7, and 8), which may be described as a stop plate. The transverse member may span gap 146 and provide a stop region 150 to restrict rotation of the hook components relative to one another, as described in more detail below.

Base 136 of each hook component may define a pair of coaxially aligned apertures 152 to receive fastener 122, which attaches the hook components to one another (see FIGS. 3-5, 7, and 8). Fastener 122 may extend through the pair of apertures 152 defined by each of the hook components 120*a*, 120*b* when bases 136 are overlapped and, optionally, interleaved (e.g., see FIG. 7).

Fastener 122 may permit the hook components to pivot relative to one another about an axis defined by the fastener. Stop region 150 of each hook component may selectively limit rotation in one rotational direction about the axis of fastener 122, through contact with a plate 144 of the other hook component. The stop regions collectively prevent rotational motion of the hook components relative to one another that would, if permitted, allow the ends of fingers 138 to move away from one another. For example, in FIG. 3 (also see FIGS. 7 and 8), contact between the underside of each transverse member 148 and an edge of one or more plates 144 of the other hook component, restricts counter-clockwise motion of hook component 120*a* and clockwise motion of hook component 120*b*.

Plates 144 of each hook component also may define a pair of coaxially aligned apertures 154 to receive a fastener 156 that attaches a cable 62 to fitting 64 at an anchor site of the fitting (see FIGS. 3, 4, 7, and 8). Each fastener 156 may, for example, be structured similarly to fastener 122 and thus may include a pin (such as a bolt) and, optionally, a nut. An end of cable 62 may include a connection element 158, such as loop, a bracket, a ring, or the like (see FIG. 3). The connection element may be sized to be received in gap 146 between plates 144 (see FIG. 7). Fastener 156 (e.g., a pin/bolt thereof) may extend through an opening defined by the connection element and through apertures 154 of only one of the hook components, at a position where the assembled hook components do not overlap one another. Alternatively, fastener 156 may extend through both hook components at an overlapping position of the components.

III. Methods of Lifeline Installation and Use

This section describes exemplary methods of installing and using the lifeline system of the present disclosure, with reference to the elements shown in FIGS. 1-8. The steps described in this section may be performed in any suitable order and combination, and may be combined with or modified by any other aspects of the present disclosure.

A frame structure 52 may be constructed. The frame structure may include a plurality of columns 58 and a plurality of beams including a pair of I-beams 60 connected to the columns. The frame structure may be a substantially complete frame or a partial frame to which additional columns and/or beams are to be added. The frame structure may be constructed for use as an internal/enclosed frame of a building or as an external/unenclosed frame of a rack or other large support structure. The frame structure optionally may include a temporary or permanent platform 68 to support one or more workers 66.

A fitting 64 may be attached to each I-beam of a pair of I-beams 60 of frame structure 52. The pair of I-beams 60 may be parallel to one another, and may be disposed laterally of one another at the same elevation of the frame structure.

Hook components 120*a*, 120*b* of each fitting 64 may be placed on each I-beam of the pair of I-beams, with the hook components overlapped with and optionally interleaved with one another and collectively extending around a flange 92 or 94 of the I-beam. Each hook component may be received on a different opposite edge region 128 or 130 of the flange, with the edge region extending into a slot 134 defined by the hook component. The slot may be defined by a pair of indentations of a pair of spaced, aligned plates 144. Apertures 152 (e.g., a pair of apertures or four apertures, among others) of the hook components may be aligned with one another, and a fastener 122 may be operatively installed such that the fastener extends through apertures 152, to attach the hook components to one another and to connect the fitting to the I-beam. The fastener may extend through the fitting at a single site and may pin the hook components to one another at a single site.

The pair of fittings 64 may be aligned with one another on a same axis that is orthogonal to both I-beams. For example, the fittings may be located the same distance from corresponding ends of the respective I-beams. The fittings may be located along the I-beams such that the fittings are in alignment with one another, or one or both of the fittings may be moved along their respective I-beams after the fittings are connected to the I-beams, to provide alignment.

A cable 62 may be connected to each fitting of the pair of fittings 64. Each opposite end of the cable may be connected to a respective fitting (and/or to a hook component thereof), before or after the fitting (and/or hook component) has been connected to an I-beam. Each end of the cable may be placed into a gap 146 between plates 144 of a hook component, and in alignment with a pair of apertures 154. A fastener 156 may be operatively installed such that the fastener extends through the pair of apertures 154 and through an opening defined by the end of the cable, and is secured to the hook component. The cable may have a length that is at least about the same as or greater than the distance between the respective pairs of apertures 154 at which opposite ends of the cable are connected to the fittings. The difference between this length and this distance, and properties of the cable, generally determine the shape of the catenary, if any, formed by the cable as the cable extends from one cable end to the other cable end.

The cable may have a length that is preselected based on (a) the distance ($d_I$) between the I-beams, such as the distance between outer sides of the webs of the pair of I-beams, and (b) the intra-fitting distance ($d_{if}$) between an I-beam contacting site (e.g., radiused end 140 of finger 138) on one hook component and an anchor site (e.g., apertures 154) of the other hook component, for each of the pair of fittings. The distance ($d_{as}$) between the corresponding cable anchor sites for the pair of fittings connected to the pair of I-beams may be calculated according to Equation 1:

$$d_{as}=d_L-2*d_{if} \tag{1}$$

The length of the cable may correspond to the distance between the cable anchor sites, and may be increased a suitable amount over this distance, to allow the cable to form a catenary and to avoid the need to tension the cable excessively as the cable is being connected to the pair of fittings.

One or more additional cables may be connected to the frame structure via fittings 64. The additional cables may be parallel or orthogonal to the first cable. At least one of the additional cables may be attached to one of the same fittings as the first cable.

A worker may become connected to at least one of the cables. For example, the worker may be connected to a cable via a tether having an end that is slidable along the cable.

The worker may be supported by a platform above the ground, and the cable and tether may be configured to collectively support the worker above the ground if the worker loses the support of the platform.

In some embodiments, the lifeline system may be characterized as follows.

A0. A high-rise structural-frame, anti-fall, worker-safety lifeline system employable in relation to a building frame structure which includes upright columns and horizontally disposed I-beams, featuring for use in laterally spaced pairs associated with adjacent, laterally spaced, worker-overhead, horizontal I-beams, positionally-adjustable, cable-receiving safety fittings, each removably, and longitudinally slidably, mountable on the underside flange region of an elongate, worker-overhead I-beam, possessing a configuration designed for freely cross-sectionally enveloping the lower flange of such a beam, and having laterally spaced, opposing fingers with radiused ends disposed to engage under load, and "datum" from, the opposite sides of the vertical web in such a beam, with any relevant load-bearing relative to an I-beam occurring between the radiused finger ends and the laterally spaced, similarly radiused regions of joinder existing between the beam's web and its lower flange, and with the fitting possessing body structure furnishing a pair of laterally outwardly spaced endo anchoring points accommodating endo attachments of the ends of horizontal, catenary lifeline cables disposed to extend between a pair of laterally adjacent I-beam-mounted fittings, and which catenary cables, where they extend between I-beams, accommodating releasably attachable, worker-specific-affixed lifelines.

A1. The system of characterization A0, wherein each fitting includes detachably couplable, interdigitatable, generally C-shaped components configured to accommodate I-beam-cross-sectional-size-independent, free longitudinal slidable mounting, as described above, on an I-beam.

A2. The system of characterization A1, which further includes unidirectional, component-relative-to-component, antirotation, anti-opening stops joined to the fitting components.

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. The subject matter of the inventions includes all novel and nonobvious combinations and subcombinations of the various elements, features, functions, and/or properties disclosed herein. The following claims particularly point out certain combinations and subcombinations regarded as novel and nonobvious. Inventions embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the inventions of the present disclosure. Further, ordinal indicators, such as first, second, or third, for identified elements are used to distinguish between the elements, and do not indicate a particular position or order of such elements, unless otherwise specifically stated.

We claim:

1. A lifeline system for a worker, the lifeline system comprising:

a frame structure including upright columns and horizontal I-beams;

a pair of fittings respectively connected to a horizontally-spaced pair of the I-beams, each respective fitting of said pair of fittings having a first hook component and a second hook component received on respective opposite edge regions of a bottom flange of a respective I-beam of the pair of said I-beams, the first hook component and the second hook component of said respective fitting being attached to one another only with a single fastener assembly having only one shaft, such that said respective fitting spans the bottom flange transversely and is supported by the respective I-beam, and such that the single fastener assembly prevents transverse removal of said respective fitting from the respective I-beam, wherein a major longitudinal length of the only one shaft is parallel to a major longitudinal length of the respective I-beam, wherein each of the first hook component and the second hook component respectively includes a pair of spaced parallel plate members connected by a transverse plate, and wherein each of the hook components are identical to one another; and a cable directly connected between the pair of fittings, wherein the cable is configured to arrest a fall of the worker attached to the cable.

2. The lifeline system of claim 1, wherein, for each said respective fitting, one of the plate members of the first hook component of the respective fitting is partially received within a gap between the pair of plate members of the second hook component of the respective fitting, and one of the plate members of the second hook component of the respective fitting is partially received within a gap between the pair of plate members of the first hook component of the respective fitting.

3. The lifeline system of claim 1, wherein the first and second hook components of said respective fitting collectively form a pair of projecting portions extending in opposite directions toward a web of the respective I-beam of the pair of said I-beams, and wherein the transverse plate of each of the first and second hook components of the respective fitting is positioned to contact the other of the first and second hook components of the respective fitting to restrict rotation of the first and second hook components relative to one another that would move the projecting portions away from one another.

4. The lifeline system of claim 1, wherein the first and second hook components of each said respective fitting collectively form a pair of projecting portions extending in opposite directions toward a central web of the respective I-beam of the pair of said I-beams, and wherein each of the projecting portions has a radiused end region configured to be positioned adjacent a radiused surface region of the respective I-beam of the pair of said I-beams, the radiused surface region being located between the central web and the bottom flange of the respective I-beam when the respective fitting is connected to the respective I-beam.

5. The lifeline system of claim 1, wherein the fastener assembly of each said respective fitting has a single bolt and a single nut.

6. The lifeline system of claim 1, wherein each said respective fitting defines apertures to receive a pair of fasteners to connect a pair of cables to the respective fitting.

7. The lifeline system of claim 1, wherein each said respective fitting defines an opening having a vertical section to receive a web region of the respective I-beam of the pair of said I-beams and a horizontal section extending in opposite horizontal directions from the vertical section.

8. The lifeline system of claim 7, wherein the opening is T-shaped in profile.

9. The lifeline system of claim 1, further comprising a worker's safety tether connected releasably to the cable.

10. The lifeline system of claim 1, wherein the pair of plate members each form a hook configured to be received on a same edge region of the bottom flange.

* * * * *